US010426220B2

(12) United States Patent
Blunkall

(10) Patent No.: US 10,426,220 B2
(45) Date of Patent: Oct. 1, 2019

(54) POINTE SHOES WITH ENHANCED IMPACT PROTECTION AND RESISTANCE TO MOISTURE DEGRADATION

(71) Applicant: Sandra Allison Blunkall, Murfreesboro, TN (US)

(72) Inventor: Sandra Allison Blunkall, Murfreesboro, TN (US)

( * ) Notice: Subject to any disclaimer, the term of this patent is extended or adjusted under 35 U.S.C. 154(b) by 110 days.

(21) Appl. No.: 15/723,482

(22) Filed: Oct. 3, 2017

(65) Prior Publication Data

US 2019/0098956 A1 Apr. 4, 2019

(51) Int. Cl.

| | |
|---|---|
| ***A43B 5/12*** | (2006.01) |
| ***A43B 13/02*** | (2006.01) |
| ***A43B 23/08*** | (2006.01) |
| ***A43B 13/41*** | (2006.01) |
| ***A43B 3/10*** | (2006.01) |
| *A43B 13/12* | (2006.01) |

(52) U.S. Cl.

CPC ..... *A43B 5/12* (2013.01); *A43B 3/10* (2013.01); *A43B 13/026* (2013.01); *A43B 13/41* (2013.01); *A43B 23/081* (2013.01); *A43B 13/12* (2013.01)

(58) Field of Classification Search

CPC ..... A43B 3/10; A43B 5/12; A43B 23/081
USPC ..... 36/8.3, 10
See application file for complete search history.

(56) References Cited

U.S. PATENT DOCUMENTS

| | | | | |
|---|---|---|---|---|
| 1,553,196 A | | 9/1925 | Solomonoff | |
| 1,704,281 A | * | 3/1929 | Capezio | A43B 5/12 36/113 |
| 1,717,659 A | | 6/1929 | Bunnell | |
| 1,744,122 A | | 1/1930 | Keeling | |
| 1,619,766 A | | 8/1931 | Capezio | |

(Continued)

FOREIGN PATENT DOCUMENTS

| | | |
|---|---|---|
| EP | 1325688 A1 | 7/2003 |
| EP | 2023756 B1 | 9/2016 |

OTHER PUBLICATIONS

Website Link: http://enpointeorthotics.com.au/ Downloaded Jan. 23, 2017 Inserts made from silicone wrapped around the toes.

(Continued)

*Primary Examiner* — Marie D Bays

(74) *Attorney, Agent, or Firm* — Russ Weinzimmer & Associates, P.C.

(57) ABSTRACT

A pointe shoe combines enhanced impact protection for the toes of a dancer provided by at least one viscoelastic polymer layer, with resistance to moisture degradation of internal structural components of the pointe shoe provided by two surrounding layers of silicone that present a moisture barrier against perspiration. The pointe shoe includes a tip portion, front portion, right side portion, and left side portion having an outer fabric layer; an outer silicone layer bonded to the outer fabric layer presenting an outer moisture barrier; a paper mache layer, attached to the silicone layer; a viscoelastic urethane polymer layer, attached to the paper mache layer, to evenly spread impact of pointed toes of the dancer; an inner silicone layer, attached to the viscoelastic urethane polymer layer, the inner silicone layer presenting an inner moisture barrier to protect at least the paper mache layer from moisture; and an inner breathable fabric layer.

18 Claims, 4 Drawing Sheets

(56) References Cited

U.S. PATENT DOCUMENTS

| | | | | |
|---|---|---|---|---|
| 1,953,659 | A * | 4/1934 | Savino | A43B 5/12 36/113 |
| 2,810,214 | A | 10/1957 | Wolfe | |
| 4,026,046 | A | 5/1977 | Clark et al. | |
| 5,035,069 | A | 7/1991 | Minden | |
| 5,101,579 | A * | 4/1992 | Terlizzi | A43B 5/12 36/113 |
| 5,129,165 | A * | 7/1992 | Woodle | A43B 5/12 36/8.3 |
| 5,469,641 | A | 11/1995 | Subotic | |
| 5,740,618 | A | 4/1998 | Minden | |
| 6,705,026 | B1 * | 3/2004 | Arbour | A43B 5/12 36/71 |
| 6,810,603 | B1 * | 11/2004 | Cosentino | A43B 5/12 36/8.3 |
| 6,895,694 | B2 * | 5/2005 | Nye | A43B 5/12 36/8.3 |
| 7,673,396 | B2 | 3/2010 | Terlizzi et al. | |
| 7,765,718 | B2 | 8/2010 | Wilkenfeld | |
| 7,827,707 | B2 * | 11/2010 | Davis | A43B 3/26 36/71 |
| 7,900,375 | B2 | 3/2011 | Thoraval | |
| 8,516,717 | B2 | 8/2013 | Bonilla-Espada | |
| 8,745,893 | B2 * | 6/2014 | Gavrieli | A43B 3/248 36/8.3 |
| 8,943,707 | B2 | 2/2015 | Moretti | |
| 9,314,068 | B2 * | 4/2016 | Schmutte | A43B 5/12 |
| 2005/0022421 | A1 | 2/2005 | Bruckner | |
| 2007/0000149 | A1 * | 1/2007 | Juniman | A43B 5/12 36/8.3 |
| 2008/0034612 | A1 * | 2/2008 | Palattella | A43B 5/12 36/8.3 |
| 2010/0115792 | A1 | 5/2010 | Muller | |
| 2010/0281715 | A1 | 11/2010 | Cayol et al. | |
| 2014/0352170 | A1 | 12/2014 | Heathcote | |

OTHER PUBLICATIONS

Website Link: http://perfectfitpointe.com/shop/perfectfit-pointe-shoeinserts-kit Downloaded Jan. 23, 2017 Molded PerfectFit insert.

Website Link: https://www.behance.net/gallery/3346353/NIKE-ARC-ANGELS-(Pointeshoe-training) Downloaded Jan. 23, 2017 Nike Arc Angels.

Website Link: http://www.planetdancedirect.co.uk/Bloch-Tiomphe-Pointe-Shoe-with-Suede-Cap Downloaded Jan. 23, 2017 Tiomphe Pointe Shoe.

* cited by examiner

POINTE SHOES WITH ENHANCED IMPACT PROTECTION AND RESISTANCE TO MOISTURE DEGRADATION

FIELD OF THE INVENTION

This invention relates to dance shoes, and particularly to ballet pointe shoes.

BACKGROUND OF THE INVENTION

Many attempts have been made to improve the classic dance shoe for dancing "en pointe", i.e., ballet dancing such that the dancer appears to float gracefully through the air while dancing on her toes.

Classic pointe shoes are very uncomfortable new out of the box, and require extensive breaking in before they can be worn. However, such shoes are so fragile, that after being broken in, they do not last more than an hour during a performance. This is partly due to deterioration of the internal structural materials of the toe box and the shank caused by perspiration from the foot during the exertions of dancing. Deterioration of the toe box and the shank results in reduced support provide by the pointe shoe, causing fatigue and increased risk of injury.

Recently, pointe shoes have been introduced that incorporate materials designed to mimic the body's natural ability to protect against impact shock, such as Sorbothane® viscoelastic polymer. For example, U.S. Pat. No. 6,705,026 B1 includes a very thin layer (e.g., 1-2 mm) of viscoelastic polymer that directly contacts the skin of the toes, or contacts the toes via a layer of fabric bonded to the thin layer of viscoelastic polymeric material. In some embodiments, the viscoelastic polymer delivers mineral oil or medication to soften the skin of the toes of the dancer. In other embodiments, the layer of viscoelastic polymer is fenestrated, i.e., provided with many small holes so as to ventilate or otherwise reduce moisture build-up between the layer of viscoelastic polymer layer and the skin of the dancer's foot.

Nevertheless, perspiration from the foot produced during strenuous dancing eventually reaches the inner layers of structural materials of the toe box and the shank, which are vulnerable to degradation due to moisture, thereby causing deterioration of the structural materials. The resulting reduced support provided by the pointe shoe contributes to fatigue and increased risk of injury, and consequently limits the useful life of the pointe shoe.

SUMMARY OF THE INVENTION

The pointe shoe of the invention combines enhanced impact protection for the toes of a dancer provided by at least one viscoelastic polymer layer, with resistance to moisture degradation of internal structural components of the pointe shoe provided by two layers of silicone that present a moisture barrier against perspiration.

A general aspect of the invention is a pointe shoe for enhancing a dancer's ability to stand on pointed toes, the pointe shoe having a tip portion, a front portion, a right side portion, a left side portion, a front bottom portion, and a rear bottom portion. The tip portion, the front portion, the right side portion, and the left side portion includes: an outer fabric layer configured to present an attractive outer surface of the point shoe; an outer silicone layer, attached inside the outer fabric layer, the outer silicone layer being configured to present an outer moisture barrier; a paper mache layer, attached to the silicone layer; a viscoelastic urethane polymer layer, attached to the paper mache layer, configured to evenly spread impact of pointed toes of the dancer; an inner silicone layer, attached to the viscoelastic urethane polymer layer, the inner silicone layer being configured to present an inner moisture barrier to protect at least the paper mache layer from moisture; and an inner fabric layer, attached to the inner silicone layer, configured so as to allow the toes of the dancer to breathe.

In some embodiments, the tip portion further includes: a neoprene rubber layer, attached to the viscoelastic urethane polymer layer, the neoprene rubber layer being configured to absorb impact and vibration of the toes of the dancer.

In some embodiments, the tip portion further includes: a second viscoelastic urethane polymer, attached to the viscoelastic urethane polymer layer.

In some embodiments, the tip portion further includes: a second viscoelastic urethane polymer layer, attached to viscoelastic urethane polymer layer; and a third viscoelastic urethane polymer layer, attached to the second viscoelastic urethane polymer layer.

In some embodiments, the front bottom portion and the rear bottom portion includes: an outer leather layer, the outer leather layer configured to present a durable surface while standing flat-footed; an outer silicone layer, attached inside the outer fabric layer, the outer silicone layer being configured to present an outer moisture barrier; a wood layer, attached to the silicone layer, the wood layer being configured to provide resilient support; a viscoelastic urethane polymer layer, attached to the wood layer, a viscoelastic urethane polymer layer being configured to evenly spread impact from a foot of the dancer; an inner silicone layer, attached to the viscoelastic urethane polymer layer, the inner silicone layer being configured to present an inner moisture barrier; and an inner fabric layer, configured so as to breathability to feet of the dancer.

In some embodiments, the front bottom portion further includes: a paper mache layer, the paper mache layer being between and attached to the wood layer and the outer silicone layer.

Another general aspect of the invention is a pointe shoe for enhancing a dancer's ability to stand on pointed toes, this point shoe including: a tip portion having: a layer of silicone, a layer of visco-elastic urethane polymer; a front portion, extending forward from the tip portion, the front portion having: a layer of silicone, a layer of visco-elastic urethane polymer; a front right side portion and a front left side portion, each extending sideward from the tip portion, each front right side and front left side portion having: a layer of silicone; a front bottom portion, extending rearward from the tip portion, the front bottom portion having: a layer of silicone, a layer of visco-elastic urethane polymer; and a rear bottom portion, extending upward from the bottom portion, and joining the right side and left side portions, the back portion having: a layer of silicone, a layer of visco-elastic urethane polymer.

In some embodiments, the layer of visco-elastic urethane polymer of the tip portion is between 1/16" and 1" in thickness, and is between 25 and 80 Shore OO Durometer in hardness.

In some embodiments, the tip portion further includes a layer of neoprene rubber attached to the layer of visco-elastic urethane polymer.

In some embodiments, the tip portion further includes: a second layer of visco-elastic urethane polymer attached to the layer of visco-elastic urethane polymer.

In some embodiments, the tip portion further includes a second layer of visco-elastic urethane polymer and a third layer of visco-elastic urethane polymer attached to the layer of visco-elastic urethane polymer.

In some embodiments, the tip portion, the front portion, the front right side portion, and the front left side portion further include: an outer layer of fabric attached to the layer of silicone.

In some embodiments, the tip portion, the front portion, the front right side portion, and the front left side portion further include an inner layer of fabric attached to the layer of visco-elastic urethane polymer.

In some embodiments, the rear bottom portion further includes a layer of wood between the layer of silicone, and the layer of visco-elastic urethane polymer.

In some embodiments, the rear bottom portion further includes an external layer of leather covering the layer of silicone.

In some embodiments, the rear bottom portion further includes a layer of wood and a layer of paper mache between the layer of silicone, and a layer of visco-elastic urethane polymer.

In some embodiments, the rear bottom portion further including an external layer of leather covering the layer of silicone.

In some embodiments, the tip portion, the front portion, the front right side portion, and the front left side portion further include: a layer of paper mache; an outer layer of silicone attached to the layer of paper mache; and an outer layer of fabric attached to the outer layer of silicone.

In some embodiments, the tip portion further includes a layer of ballistic fabric attached to the layer of silicone.

In some embodiments, the tip portion further includes a layer of ballistic fabric attached to the outer layer of fabric.

BRIEF DESCRIPTION OF THE DRAWINGS

Many additional features and advantages will become apparent to those skilled in the art upon reading the following description, when considered in conjunction with the accompanying drawings, wherein.

DETAILED DESCRIPTION

In each of FIGS. 1-4, the layers that make up various portions of the pointe shoe are shown in schematic form. More specifically, a portion of the pointe shoe is generally indicated by a smaller circle having a pair of diverging tangent lines that also form tangents to a larger circle, the larger circle containing an enlarged schematic cross-sectional view of the layer structure of the area generally surrounding the smaller circle.

Figure 1:
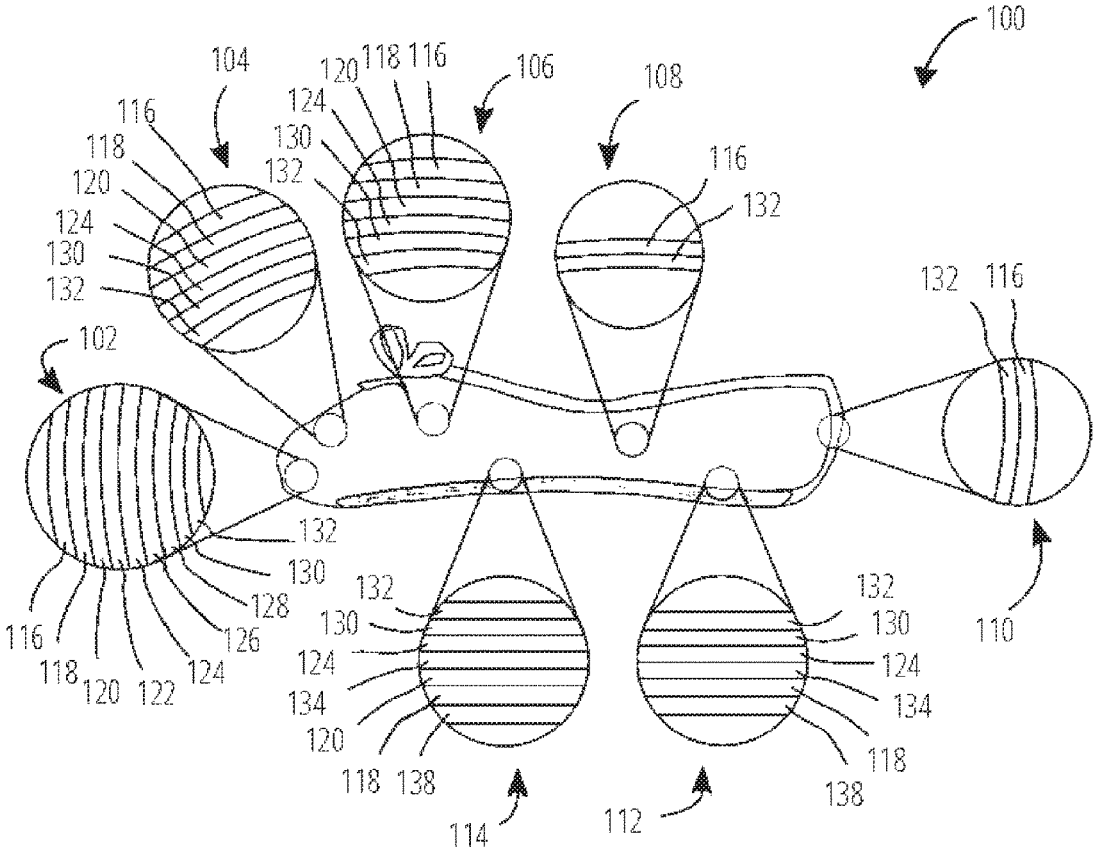
FIG. 1 is a left side view of a pointe shoe in a flat position.
Figure 4:
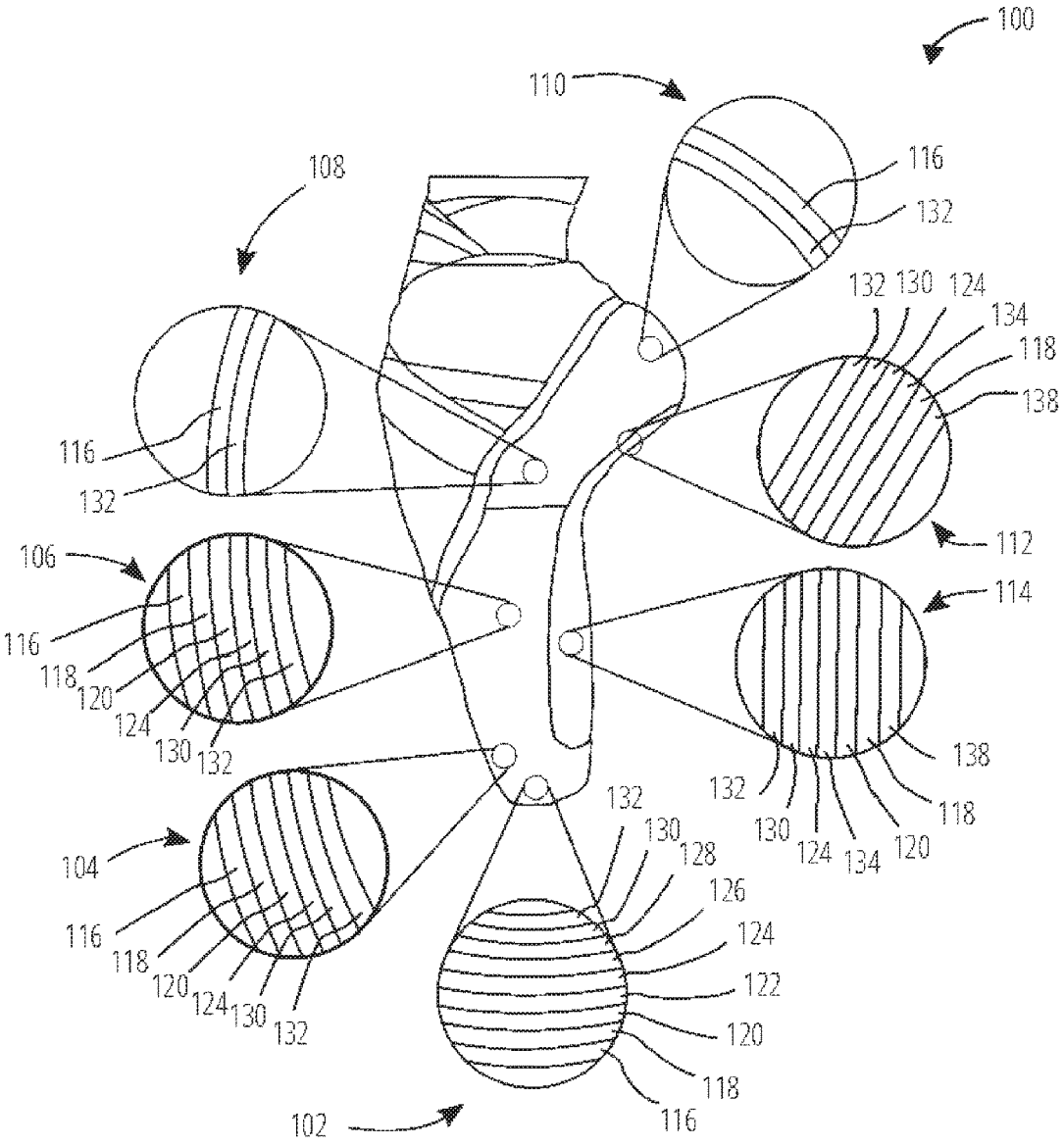
FIG. 4 is a right side view of the pointe shoe of FIG. 1.

FIGS. 1 and 4 show a pointe shoe 100, including seven cross-section views of the layer structure of seven respective portions of the pointe shoe 100: a tip portion 102, a front portion 104, a front left side portion 106, a rear left side portion 108, a back portion 110, a rear bottom portion 112, and a front bottom portion 114.

An outer fabric layer 116, such as made from satin, covers all portions except the rear bottom portion 112, and the front bottom portion 114.

An outer layer of silicone 118, serving as an external moisture barrier, extends from the tip portion 102, through the front portion 104, and through the front left side portion 106, and also through the front bottom portion 114, and through the rear bottom portion 112. An inner layer of silicone 130, serving as an internal moisture barrier, also extends from the tip portion 102, through the front portion 104, and through the front left side portion 106, and also through the front bottom portion 114, and through the rear bottom portion 112, thereby protecting layers that experience degradation in the presence of moisture. Thus, for example, the layer of leather 138 that extends through the front bottom portion 114, and through the rear bottom portion 112, is protected by the silicone layers 130 and 118 from moisture due to perspiration produced by a foot inside the shoe 100.

As another example, the paper mache layer 120 that extends through portions 106, 104, 102, and 114 (thereby forming a part of the pointe shoe 100 called the "toe box") is protected by the inner silicone layer 130 from moisture due to sweat produced by a foot wearing the shoe 100. Paper mache can be made using cardboard, glue, paper, and canvas, as is known by those skilled in the art.

Further, the silicone layers 130 and 118 also protect the layer of wood 134, that extends through portions 114 and 112, from moisture due to sweat produced by the foot wearing the shoe 100.

Many embodiments of the pointe shoe 100 include a plurality of layers for absorbing and spreading impact as a dancer dances en pointe. For example, in the embodiment shown in FIGS. 1, 2, and 4, a neoprene rubber layer 122 adds impact absorption properties to the tip portion 102. The neoprene rubber layer 122 can be between 0.10 inches and 2.0 inches in thickness.

In an exemplary embodiment, the neoprene rubber layer 122 is ⅛" inch thick. Then the first visco-elastic polymer layer 124 is ⅛" inch thick, 50 Durometer, the second visco-elastic polymer layer 126 is ⅛" inch thick, 50 Durometer, and the third visco-elastic polymer layer 128 is ⅛" inch thick, 50 Durometer. Alternatively, the first visco-elastic polymer layer 124 can be ⅜" inch thick, 50 Durometer, as one single layer on top of a ⅛" inch thick neoprene rubber layer 122. In another embodiment, four consecutive layers of ⅛" inch thick visco-elastic polymer, 50 Durometer, can be used without including a neoprene rubber layer, for a total thickness of ½" inch. In yet another embodiment, a single piece of visco-elastic polymer that is ½" inch thick, 50 Durometer, can be used without including a neoprene rubber layer.

A first layer of visco-elastic urethane polymer 124 (e.g., Sorbothane®) adds impact distribution properties through the tip portion 102, the front portion 104, the left side portion 106, the right side portion 202 (see FIG. 2), the front bottom portion 114, and the rear bottom portion 112.

Sorbothane® absorbs up to 94.7% of impact shock before it enters the body. Such visco-elastic polymers help to protect the entire body from damage due to dangerous shock waves. Such visco-elastic polymer layers never bottom out, and consequently perform effectively even in extreme conditions.

The first layer of visco-elastic urethane polymer 124 can be between 1/16 inches and 1.0 inches in thickness, and can be between 25 Durometer and 80 Durometer in hardness, using Shore Durometer Scale OO. Hardness can be defined as a material's resistance to indentation. "Durometer" is one of several measures of hardness of a material. Higher Durometer numbers indicate harder materials; lower Durometer numbers indicate softer materials.

In this embodiment, a second layer of visco-elastic urethane polymer 126, and a third layer of visco-elastic urethane polymer 128 can be included to add impact absorption and impact distribution properties to the tip portion 102. In other embodiments, the layers 126 and 128 can be replaced by a single layer (not shown) of a thickness greater than either of the layers 126 and 128, such as being twice the thickness of the first layer of visco-elastic urethane polymer 124.

Figure 3:
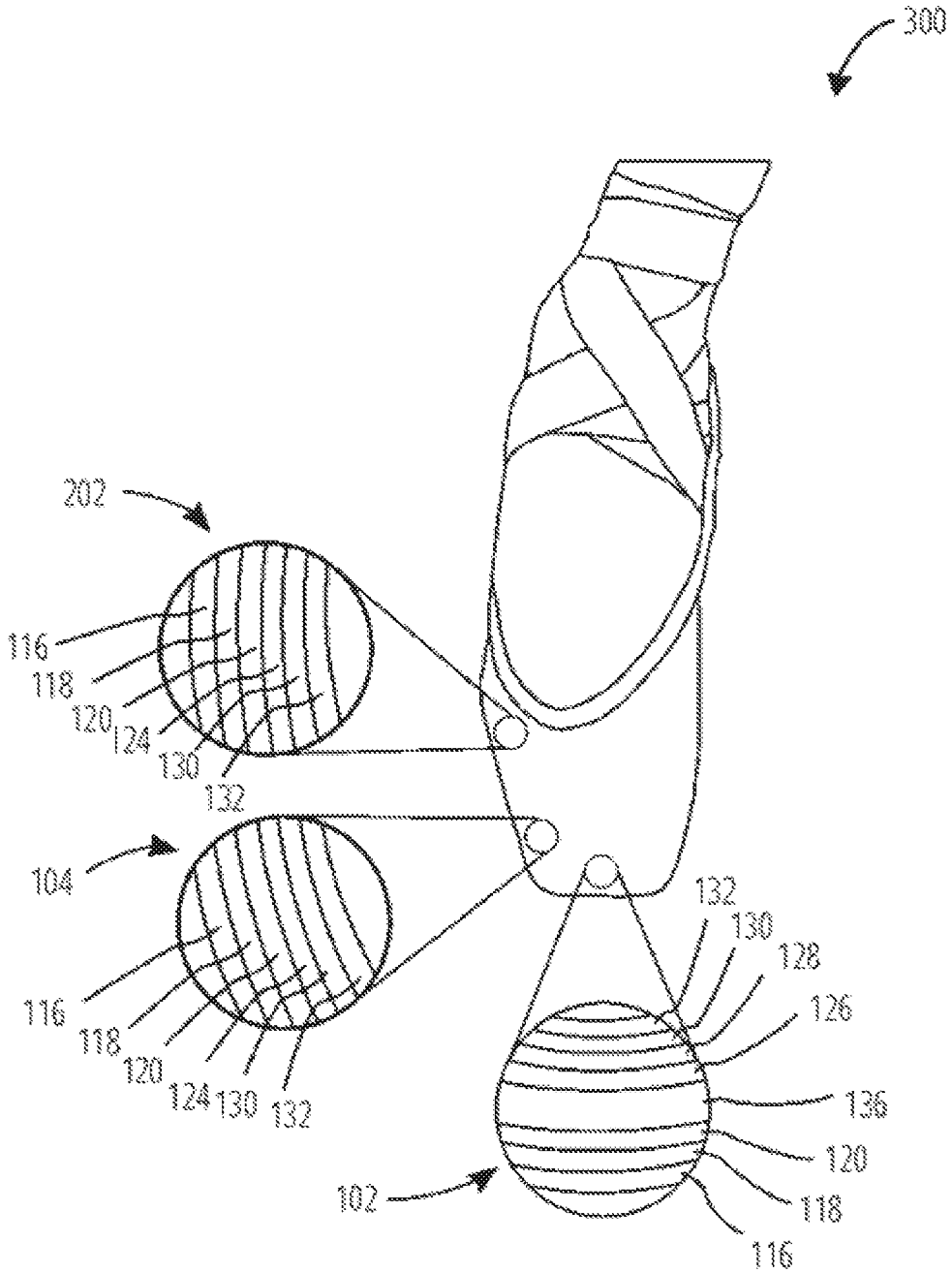
FIG. 3 is a top front view of a pointe shoe, shown en pointe, in accordance with another embodiment having a thicker layer of visco-elastic polymer in the tip portion instead of a layer of neoprene in the tip portion.

Referring to FIG. 3, in the embodiment 300 of the pointe shoe, a double thickness layer of visco-elastic urethane polymer 136 (e.g., ¼ ", 50 Durometer) replaces the neoprene layer 122 and the first visco-elastic urethane polymer layer 124.

In other embodiments, the outer fabric layer 116 of the tip portion 102 can include a layer of ballistic fabric attached to the fabric layer 116 and/or to the layer of silicone 118. This layer of ballistic fabric, such as KEVLAR®, can make the tip portion 102 more resistant to wear, thereby further extending the useful life of the pointe shoe 100.

Figure 2:
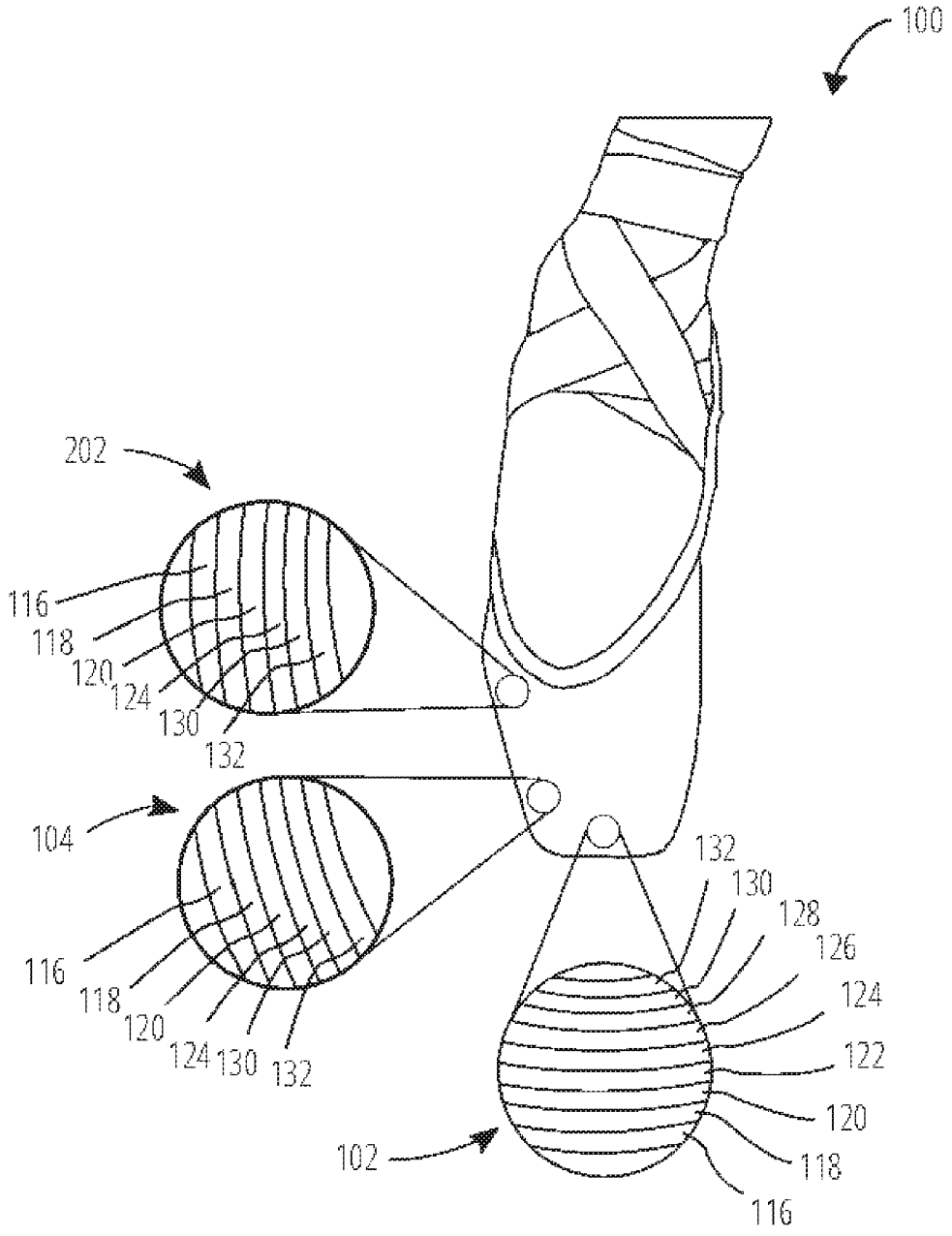
FIG. 2 is a top front view of the pointe shoe of FIG. 1, shown en pointe, in accordance with one embodiment having a layer of neoprene in the tip portion.

Referring to FIG. 2, a top front view of the pointe shoe 100 of FIG. 1 is shown. In this embodiment 100, the tip portion 102 includes an outermost outer fabric layer 116, such as satin, an outer layer of silicone 118, a layer of paper mache 120, a neoprene rubber layer 122, a first layer of visco-elastic urethane polymer 124 (e.g., ⅛", 50 Durometer), a second layer of visco-elastic urethane polymer 126 (e.g., ⅛", 50 Durometer), and an innermost third layer of visco-elastic urethane polymer 128 (e.g., ⅛", 50 Durometer). Then, an inner layer of silicone 130 protects all of the underlying layers from moisture due to sweat from the foot wearing the shoe 100. An inner fabric layer 132, such as made from cotton, covers the silicone layer 130.

In other embodiments, the tip portion 102 has an outermost outer fabric layer 116, a layer of silicone 118, a paper mache layer 120, a neoprene rubber layer 122, a first layer of visco-elastic urethane polymer 124, and an innermost second layer of visco-elastic urethane polymer 126, which can be thicker than the first layer 124.

In yet other embodiments, the tip portion 102 has an outermost outer fabric layer 116, a layer of silicone 118, a paper mache layer 120, a neoprene rubber layer 122, and a single layer of visco-elastic urethane polymer 124 that is thicker than the neoprene rubber layer 122.

The neoprene rubber layer 122 in the tip portion 102 is bonded to the layer of visco-elastic urethane polymer 124, and is configured to absorb impact and vibration, and to evenly spread any impact on a tip portion of a dancer's toes (not shown).

In some embodiments, the tip portion 102 include a layer of visco-elastic urethane polymer 124 of ⅜" thickness and 50 Duro.

In other embodiments, the tip portion 102 includes a layer of visco-elastic urethane polymer 124 of ½" thickness and 50 Duro.

In this embodiment 100, the front portion 104 includes an outermost fabric layer 116, an outer layer of silicone 118, a layer of paper mache 120, a layer of visco-elastic urethane polymer 124 (e.g., ⅛", 50 Durometer), an inner layer of silicone 130, and an inner fabric layer 132. The outer fabric layer 116, the outer layer of silicone 118, the paper mache layer 120, the layer of visco-elastic urethane polymer 124 (e.g., ⅛", 50 Durometer), the outer silicone layer 118, and the inner fabric layer 132 extend from the tip portion 102, through the front portion 104, and into the front right portion 202, and the front left portion 106 (FIG. 1).

In some embodiments, the front right side portion 202 does not include a layer of visco-elastic urethane polymer 124.

Referring again to FIG. 1 and to FIG. 4, in this embodiment 100, the rear left side portion 108 has an outermost fabric layer 116, and an innermost layer of fabric 132.

In this embodiment 100, the back portion 110 has an outermost fabric layer 116 (e.g. satin), and an innermost fabric layer 132 (e.g., cotton).

In this embodiment 100, the rear bottom portion (also called the "outer sole") 112 has an outermost layer of leather 138, an outer layer of silicone 118, a layer of wood 134, a layer of visco-elastic urethane polymer 124 (e.g., ⅛", 50 Durometer), an inner layer of silicone 130, and an inner layer of fabric 132.

In this embodiment 100, the front bottom portion 114 has an outermost layer of leather 138, an outer layer of silicone 118, a layer of paper mache 120, a layer of wood 134, a layer of visco-elastic urethane polymer 124 (e.g., ⅛", 50 Durometer), an inner layer of silicone 130, and an inner layer of fabric 132, such as cotton to make the shoe breathable.

In some embodiments, the front bottom portion 114 has a layer of paper mache 120 extending through the front bottom portion 114 to a point between the front bottom portion 114 and the rear bottom portion 112. The front bottom portion 114 also includes a layer of wood 134 extending through the front bottom portion 114 and the rear bottom portion 112 to a point between the rear bottom portion 112 and the back portion 110.

In some embodiments, the layer of leather 138 extends all along the bottom of the pointe shoe 100, including through the front bottom portion 114 and the rear bottom portion 112.

In some embodiments, the outer fabric layer 116 extends through seven portions: the tip portion 102, the front portion 104, the front left side portion 106, the rear left side portion 108, the front right side portion 202, the rear right side portion (not shown), and the back portion 110, is made from satin. The back portion 110 can also include a back seam (not shown) which is typically made of fabric, such as satin, which is double stitched.

Other modifications and implementations will occur to those skilled in the art without departing from the spirit and the scope of the invention as claimed. Accordingly, the above description is not intended to limit the invention, except as indicated in the following claims.

What is claimed is:

1. A pointe shoe for enhancing a dancer's ability to stand on pointed toes, the pointe shoe having a tip portion, a front portion, a right side portion, a left side portion, a front bottom portion, and a rear bottom portion; the tip portion, the front portion, the right side portion, and the left side portion comprising:

an outer fabric layer configured to present an attractive outer surface of the point shoe;

an outer silicone layer, attached inside the outer fabric layer, the outer silicone layer being configured to present an outer moisture barrier;

a paper mache layer, attached to the silicone layer;

a viscoelastic urethane polymer layer, attached to the paper mache layer, configured to evenly spread impact of pointed toes of the dancer;

an inner silicone layer, attached to the viscoelastic urethane polymer layer, the inner silicone layer being configured to present an inner moisture barrier to protect at least the paper mache layer from moisture; and an inner fabric layer, attached to the inner silicone layer, configured so as to allow the toes of the dancer to breathe.

2. The pointe shoe of claim 1, the tip portion further comprising:

a neoprene rubber layer, attached to the viscoelastic urethane polymer layer, the neoprene rubber layer being configured to absorb impact and vibration of the toes of the dancer.

3. The pointe shoe of claim 1, the tip portion further comprising:

a second viscoelastic urethane polymer, attached to the viscoelastic urethane polymer layer.

4. The pointe shoe of claim 1, the tip portion further comprising:

a second viscoelastic urethane polymer layer, attached to viscoelastic urethane polymer layer; and a third viscoelastic urethane polymer layer, attached to the second viscoelastic urethane polymer layer.

5. The pointe shoe of claim 1, the front bottom portion and the rear bottom portion comprising:

an outer leather layer, the outer leather layer configured to present a durable surface while standing flat-footed;

an outer silicone layer, attached inside the outer fabric layer, the outer silicone layer being configured to present an outer moisture barrier;

a wood layer, attached to the silicone layer, the wood layer being configured to provide resilient support;

a viscoelastic urethane polymer layer, attached to the wood layer, a viscoelastic urethane polymer layer being configured to evenly spread impact from a foot of the dancer;

an inner silicone layer, attached to the viscoelastic urethane polymer layer, the inner silicone layer being configured to present an inner moisture barrier; and an inner fabric layer, configured so as to breathability to feet of the dancer.

6. The pointe shoe of claim 5, the front bottom portion further comprising:

a paper mache layer, the paper mache layer being between and attached to the wood layer and the outer silicone layer.

7. A pointe shoe for enhancing a dancer's ability to stand on pointed toes, the point shoe comprising:

a tip portion including:

a layer of silicone, a layer of visco-elastic urethane polymer, a layer of neoprene rubber attached to the layer of visco-elastic urethane polymer;

a front portion, extending forward from the tip portion, the front portion including:

a layer of silicone, a layer of visco-elastic urethane polymer;

a front right side portion and a front left side portion, each extending sideward from the tip portion, each front right side and front left side portion including:

a layer of silicone;

a front bottom portion, extending rearward from the tip portion, the front bottom portion including:

a layer of silicone, a layer of visco-elastic urethane polymer; and a rear bottom portion, extending upward from the bottom portion, and joining the right side and left side portions, the back portion including:

a layer of silicone, a layer of visco-elastic urethane polymer.

8. The pointe shoe of claim 7, wherein the layer of visco-elastic urethane polymer of the tip portion is between 1/16" and 1" in thickness, and is between 25 and 80 Shore OO Durometer in hardness.

9. The pointe shoe of claim 7, the tip portion further including:

a second layer of visco-elastic urethane polymer attached to the layer of visco-elastic urethane polymer.

10. The pointe shoe of claim 7, the tip portion further including:

a second layer of visco-elastic urethane polymer and a third layer of visco-elastic urethane polymer attached to the layer of visco-elastic urethane polymer.

11. The pointe shoe of claim 7, wherein the tip portion, the front portion, the front right side portion, and the front left side portion further include:

an outer layer of fabric attached to the layer of silicone.

12. The pointe shoe of claim 7, wherein the tip portion, the front portion, the front right side portion, and the front left side portion further include:

an inner layer of fabric attached to the layer of visco-elastic urethane polymer.

13. The pointe shoe of claim 7, the rear bottom portion further including:

a layer of wood between the layer of silicone, and a layer of visco-elastic urethane polymer.

14. The pointe shoe of claim 7, the rear bottom portion further including:

an external layer of leather covering the layer of silicone.

15. The pointe shoe of claim 7, the rear bottom portion further including:

a layer of wood and a layer of paper mache between the layer of silicone, and a layer of visco-elastic urethane polymer.

16. The pointe shoe of claim 7, wherein the tip portion, the front portion, the front right side portion, and the front left side portion further include:

a layer of paper mache;

an outer layer of silicone attached to the layer of paper mache; and an outer layer of fabric attached to the outer layer of silicone.

17. The pointe shoe of claim 7, the tip portion further including:

a layer of ballistic fabric attached to the layer of silicone.

18. The pointe shoe of claim 16, the tip portion further including:

a layer of ballistic fabric attached to the outer layer of fabric.

* * * * *